US011643299B2

(12) United States Patent
Huang et al.

(10) Patent No.: US 11,643,299 B2
(45) Date of Patent: May 9, 2023

(54) COMMUNICATION SYSTEM AND METHOD FOR ELEVATOR SYSTEM

(71) Applicant: Otis Elevator Company, Farmington, CT (US)

(72) Inventors: Wenbo Huang, Shanghai (CN); Xiaofei Guo, Shanghai (CN)

(73) Assignee: OTIS ELEVATOR COMPANY, Farmington, CT (US)

( * ) Notice: Subject to any disclaimer, the term of this patent is extended or adjusted under 35 U.S.C. 154(b) by 1350 days.

(21) Appl. No.: 16/013,531

(22) Filed: Jun. 20, 2018

(65) Prior Publication Data

US 2018/0370758 A1 Dec. 27, 2018

(30) Foreign Application Priority Data

Jun. 22, 2017 (CN) ..... 201710480417.6

(51) Int. Cl.

| | |
|---|---|
| ***B66B 1/46*** | (2006.01) |
| ***B66B 1/34*** | (2006.01) |
| ***B66B 1/24*** | (2006.01) |
| ***B66B 1/50*** | (2006.01) |

(52) U.S. Cl.

CPC ..... *B66B 1/3453* (2013.01); *B66B 1/2408* (2013.01); *B66B 1/3461* (2013.01); *B66B 1/468* (2013.01); *B66B 1/50* (2013.01); *B66B 2201/102* (2013.01); *B66B 2201/4623* (2013.01); *B66B 2201/4638* (2013.01); *B66B 2201/4653* (2013.01)

(58) Field of Classification Search

CPC ..... B66B 1/24–2491; B66B 1/28; B66B 1/3415; B66B 1/3423; B66B 1/3446–3461; B66B 2201/10–102

See application file for complete search history.

(56) References Cited

U.S. PATENT DOCUMENTS

| | | | |
|---|---|---|---|
| 4,568,909 | A | 2/1986 | Whynacht |
| 6,601,679 | B2 | 8/2003 | Crenella et al. |
| 6,868,945 | B2 | 3/2005 | Schuster et al. |
| 6,986,408 | B2 | 1/2006 | Takeuchi |
| 7,426,981 | B2 | 9/2008 | Bacellar et al. |

(Continued)

FOREIGN PATENT DOCUMENTS

| | | | |
|---|---|---|---|
| CN | 101021971 | A | 8/2007 |
| CN | 200997175 | Y | 12/2007 |

(Continued)

OTHER PUBLICATIONS

European Search Report for application EP 18179075.9, dated Jan. 4, 2019, 8 pages.

*Primary Examiner* — Christopher Uhlir

(74) *Attorney, Agent, or Firm* — Cantor Colburn LLP

(57) ABSTRACT

Provided is a communication system and a communication method for use in an elevator system, which belong to the field of elevator intelligent control technologies. The communication system of the present invention comprises: a first bluetooth module mounted in an elevator landing area of the elevator system and a second bluetooth module mounted in an elevator car of the elevator system. The communication system and the communication method of the present invention can realize that a passenger completes an elevator calling operation in a completely hand-free mode, which is easy to realize and is low in cost.

45 Claims, 7 Drawing Sheets

(56) References Cited

U.S. PATENT DOCUMENTS

| | | | | |
|---|---|---|---|---|
| 7,552,800 | B2 | 6/2009 | Puskala et al. | |
| 7,664,464 | B2 | 2/2010 | Gerstenkorn | |
| 8,047,333 | B2 | 11/2011 | Finschi | |
| 8,151,942 | B2 | 4/2012 | Rusanen et al. | |
| 8,401,472 | B2 | 3/2013 | Gerstenkorn | |
| 8,485,317 | B2 | 7/2013 | Gerstenkorn et al. | |
| 9,087,246 | B1 | 7/2015 | Chin et al. | |
| 9,284,158 | B2 | 3/2016 | Sarjanen | |
| 10,401,178 | B2 * | 9/2019 | Jantunen | G01S 3/046 |
| 2006/0108181 | A1 | 5/2006 | Bacellar et al. | |
| 2012/0305340 | A1 | 12/2012 | Wu | |
| 2015/0274486 | A1 | 10/2015 | Wilke et al. | |
| 2015/0368067 | A1 * | 12/2015 | Tang | B66B 1/468 187/380 |
| 2016/0090270 | A1 | 3/2016 | Wang | |
| 2016/0198499 | A1 * | 7/2016 | Lee | H04W 4/026 455/450 |
| 2016/0248782 | A1 | 8/2016 | Troesch | |
| 2016/0304312 | A1 | 10/2016 | Thompson | |
| 2016/0311647 | A1 | 10/2016 | Peterson et al. | |

FOREIGN PATENT DOCUMENTS

| | | | |
|---|---|---|---|
| CN | 202808099 | U | 3/2013 |
| CN | 203134099 | U | 8/2013 |
| CN | 103646667 | A | 3/2014 |
| CN | 103663008 | A | 3/2014 |
| CN | 203682797 | U | 7/2014 |
| CN | 204057529 | U | 12/2014 |
| CN | 104331974 | A | 2/2015 |
| CN | 204155273 | U | 2/2015 |
| CN | 204288344 | U | 4/2015 |
| CN | 104609270 | A | 5/2015 |
| CN | 104986633 | A | 10/2015 |
| CN | 105016151 | A | 11/2015 |
| CN | 204873294 | U | 12/2015 |
| CN | 204897058 | U | 12/2015 |
| CN | 105565091 | A | 5/2016 |
| CN | 205472059 | U | 8/2016 |
| CN | 205709261 | U | 11/2016 |
| CN | 205873545 | U | 1/2017 |
| JP | 20030204398 | A | 7/2003 |
| JP | 2005255320 | A | 9/2005 |
| JP | 2015227239 | A | 12/2015 |
| KR | 2006135427 | A | 12/2006 |
| KR | 20130142252 | A | 12/2013 |
| KR | 20170033091 | A | 3/2017 |
| WO | 02066357 | A1 | 8/2002 |
| WO | 2014178790 | A1 | 11/2014 |
| WO | 2017024096 | A1 | 2/2017 |

* cited by examiner

COMMUNICATION SYSTEM AND METHOD FOR ELEVATOR SYSTEM

FOREIGN PRIORITY

This application claims priority to Chinese Patent Application No. 201710480417.6, filed Jun. 22, 2017, and all the benefits accruing therefrom under 35 U.S.C. § 119, the contents of which in its entirety are herein incorporated by reference.

TECHNICAL FIELD

The present invention belongs to the field of Elevator intelligent control technologies, and relates to a communication system and a communication method which realize the automatic completion of an elevator calling operation in a hand free mode by utilizing bluetooth interaction between a first bluetooth module as well as a second bluetooth module and a personal mobile terminal, and an elevator system using the communication system.

BACKGROUND ART

In an existing elevator system, one of the common modes of elevator calling operation is: a passenger manually presses a certain elevator calling button on an elevator calling control panel mounted in an elevator landing area to input an elevator calling request command for traveling upward or traveling downward, and then, after entering a certain elevator car, the passenger manually presses a certain floor button on a target floor registration control panel mounted in each elevator car to input a target floor. Such an elevator calling operation mode needs to be completed through manual operations; moreover, especially when the passenger's hands are incapable of performing the above-mentioned button press operation freely (for example, the passenger is carrying stuff with both hands, or the passenger has difficulty in walking and is sitting in a wheelchair), the elevator calling operation becomes difficult, affecting the passenger's experience.

SUMMARY OF INVENTION

According to a first aspect of the present invention, provided is a communication system for use in an elevator system, including: a first bluetooth module for broadcasting a first bluetooth signal and automatically establishing a first bluetooth connection with a personal mobile terminal based on the first bluetooth signal, and receiving an elevator calling request command regarding an elevator calling direction sent from the personal mobile terminal when establishing the first bluetooth connection; and a second bluetooth module for broadcasting a second bluetooth signal and automatically establishing a second bluetooth connection with the personal mobile terminal based on the second bluetooth signal, and receiving a target floor registration command sent from the personal mobile terminal when establishing the second bluetooth connection, wherein the first bluetooth module is mounted in an elevator landing area of the elevator system, and the second bluetooth module is mounted in an elevator car of the elevator system.

According to a second aspect of the present invention, provided is an elevator system, including: a communication system provided by the first aspect of the present invention; and an elevator controller for controlling the running of one or more elevator cars in the elevator system, wherein the elevator controller is coupled to the first bluetooth module and the second bluetooth module and controls the running of the one or more elevator cars in the elevator system at least in response to the elevator calling request command and/or the target floor registration command.

According to a third aspect of the present invention, provided is a communication method for performing an elevator calling operation in an elevator system, including steps of: receiving a first bluetooth signal broadcasted by a first bluetooth module mounted in an elevator landing area of the elevator system; automatically establishing a first bluetooth connection between a personal mobile terminal and the first bluetooth module based on the first bluetooth signal; sending an elevator calling request command regarding an elevator calling direction to the first bluetooth module; disconnecting the first bluetooth connection; after disconnecting the first bluetooth connection, receiving a second bluetooth signal broadcasted by a second bluetooth module mounted in an elevator car of the elevator system; automatically establishing a second bluetooth connection between the personal mobile terminal and the second bluetooth module based on the second bluetooth signal; the personal mobile terminal sending a target floor registration command to the second bluetooth module; and disconnecting the second bluetooth connection.

According to a fourth aspect of the present invention, provided is a communication method for performing an elevator calling operation in an elevator system, wherein a first bluetooth module mounted in an elevator landing area of the elevator system broadcasts a first bluetooth signal, and a second bluetooth module mounted in an elevator car of the elevator system broadcasts a second bluetooth signal, and the method includes steps of: the first bluetooth signal being received by a personal mobile terminal near the first bluetooth module; automatically establishing a first bluetooth connection between the personal mobile terminal and the first bluetooth module based on the first bluetooth signal; the first bluetooth module receiving an elevator calling request command regarding an elevator calling direction sent from the personal mobile terminal; disconnecting the first bluetooth connection; the second bluetooth signal being received by the personal mobile terminal near the second bluetooth module; automatically establishing a second bluetooth connection between the personal mobile terminal and the second bluetooth module based on the second bluetooth signal; the second bluetooth module receiving a target floor registration command sent from the personal mobile terminal; and disconnecting the second bluetooth connection.

According to a fifth aspect of the present invention, provided is a personal mobile terminal which is configured to be able to receive a first bluetooth signal broadcasted by a first bluetooth module mounted in an elevator landing area of the elevator system and be able to receive a second bluetooth signal broadcasted by a second bluetooth module mounted in an elevator car of the elevator system, wherein the personal mobile terminal includes: a bluetooth connection management module for successively automatically establishing a first bluetooth connection with the first bluetooth module and a second bluetooth connection with the second bluetooth module respectively based on the first bluetooth signal and the second bluetooth signal; a first command sending module for automatically sending an elevator calling request command regarding an elevator calling direction to the corresponding first bluetooth module when the first bluetooth connection is established; and a second command sending module for automatically sending a target floor registration command to the corresponding second bluetooth module when the second bluetooth connection is established.

According to a sixth aspect of the present invention, provided is a personal mobile terminal, including: a memory, a processor and a computer program that is stored in the memory and can run on the processor, wherein the processor realizes steps in the communication method provided by the third aspect of the present invention when executing the program.

According to a seventh aspect of the present invention, provided is a computer readable storage medium storing a computer program thereon, wherein the program is executed by a processor to realize steps of the method provided in the third aspect of the present invention.

According to the description and accompanying drawings below, the above features and operations of the present invention will become more obvious.

BRIEF DESCRIPTION OF THE DRAWINGS

The detailed description below in conjunction with the accompanying drawings will make the above-mentioned and other objects and advantages of the present invention more complete and clearer, wherein identical or similar elements are expressed in identical labels.

DETAILED DESCRIPTION

The present invention will now be described more completely with reference to the accompanying drawings, where exemplary embodiments of the present invention are shown. However, the present invention can be implemented in many different forms and should not be understood as limitations to the embodiments elaborated here. On the contrary, these embodiments are provided so that the present disclosure becomes more thorough and complete, and fully conveys the concept of the present invention to a person skilled in the art.

Some block diagrams shown in the accompanying drawings are functional entities and are not necessarily corresponding to physically or logically independent entities. These functional entities may be implemented in the form of software, or in one or more hardware modules or integrated circuits, or in different processing apparatuses and/or microcontroller apparatuses.

Figure 1:
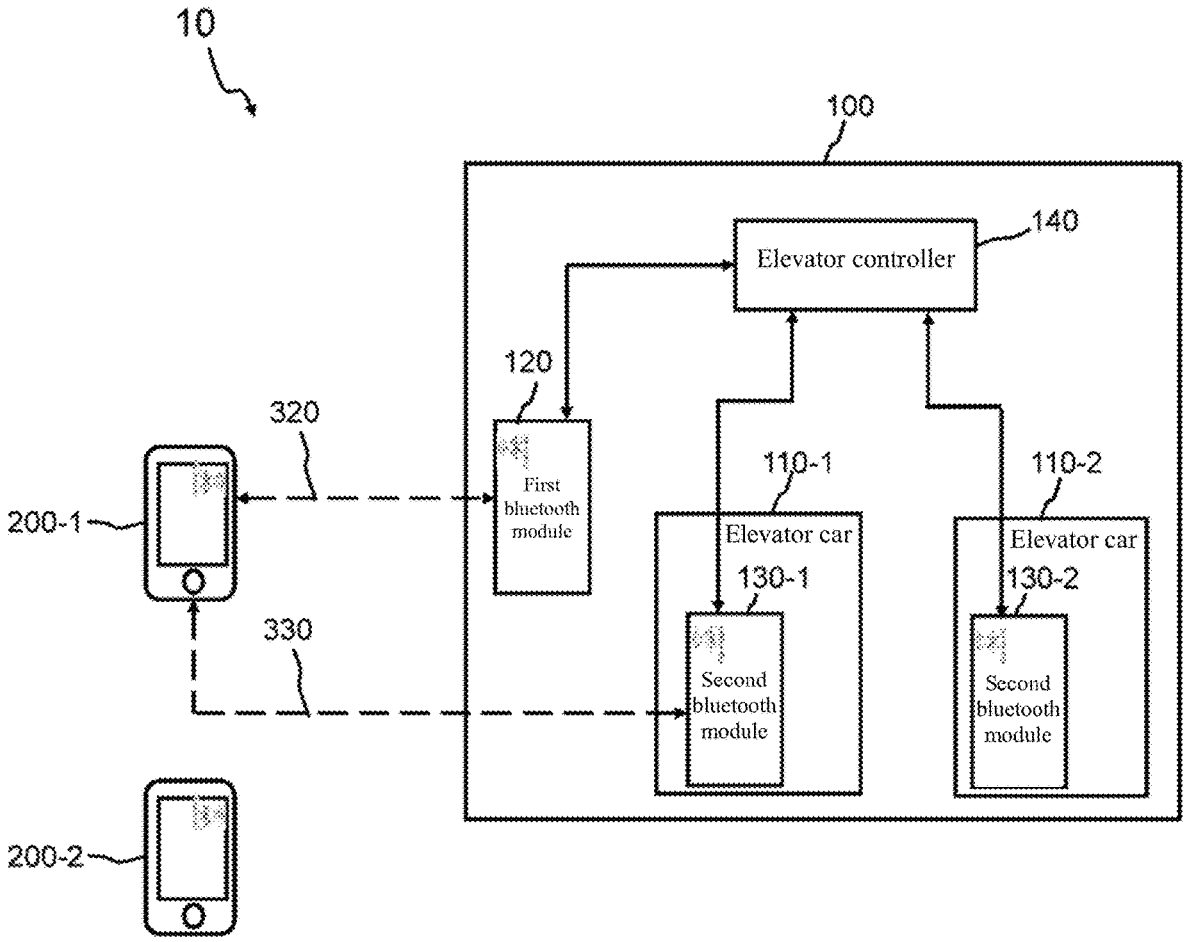
FIG. 1 is a schematic diagram of a communication system for use in an elevator system according to one embodiment of the present invention.

FIG. 1 shows a schematic diagram of a communication system for use in an elevator system according to one embodiment of the present invention. The communication system of the embodiments of the present invention is described below in conjunction with the application scenarios of FIG. 2 and FIG. 3.

The communication system 10 of the embodiments of the present invention is applied in a building which is mounted with an elevator system 100. The elevator system 100 includes a plurality of elevator cars 110 traveling up and down in hoistways of the building. FIG. 1 shows two of the elevator cars, i.e., 110-1 and 110-2. The traveling or stopping of each elevator car 110 in the hoistways, namely each elevator car 110, is controlled by an elevator controller 140 in the elevator system 100, the particular control mode or control principle of the elevator controller 140 over one or more elevator cars 110 is not restrictive, and the particular structure or arrangement manner, etc. of the elevator controller 140 is not restrictive either. Generally, the elevator controller 140 needs to acquire an elevator calling request command from each elevator landing area 410, and acquire target floor registration information about a passenger, so as to control the operation of the elevator based on them, for example, performing scheduling control over each elevator car 110.

Figure 3:
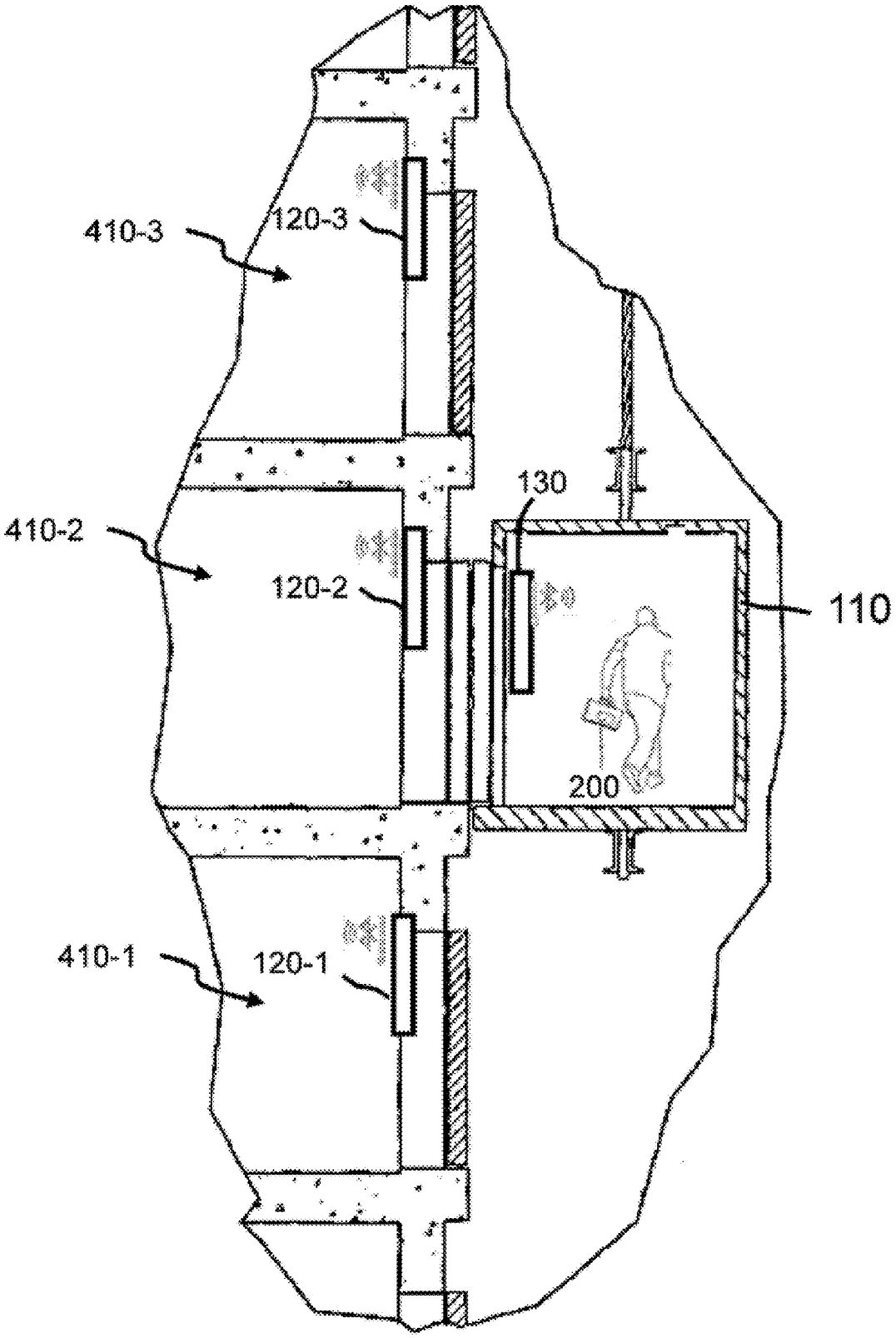
FIG. 3 is a schematic diagram of another application scenario of a communication system according to one embodiment of the present invention.

In order to acquire the elevator calling request command from each elevator landing area 410, a first bluetooth module 120 is arranged in the communication system 10; the first bluetooth module 120 can be mounted in each elevator landing area 410 of the elevator system 100 (as shown in FIG. 3), for example, the first bluetooth module 120-1 is mounted in the elevator landing area 410-1, the first bluetooth module 120-2 is mounted in the elevator landing area 410-2, and the first bluetooth module 120-3 is mounted in the elevator landing area 410-3. It should be understood that each elevator landing area 410 may be mounted with one or more first bluetooth modules 120, so that the first bluetooth signal sent out by the first bluetooth module 120 can substantially effectively cover each elevator landing area 410.

In one embodiment, the first bluetooth module 120 can be integratedly arranged in an elevator calling control panel 12 of the elevator system 100, wherein the elevator calling control panel 12 is generally mounted at two sides of the landing door of the elevator landing area 410, and the elevator calling control panel 12 can be provided with for example an "upward" or "downward" elevator calling button, so as to realize the manual input of an elevator calling request command based on the elevator calling control panel 12. The particular integration and arrangement manner of the first bluetooth module 120 with respect to the elevator calling control panel 12 will be described thereafter in conjunction with FIG. 4.

In one embodiment, the first bluetooth module 120 can particularly be a Bluetooth Low Energy (BLE) module. The first bluetooth signal broadcast or transmitted all along or persistently by the first bluetooth module 120 can substantially effectively cover the elevator landing area 410 where it is located. The first bluetooth signal can, for example, be correspondingly a BLE signal, which can include a wake-up signal for waking up a personal mobile terminal 200, or further include a data signal that reflects a universally unique identifier (UUID) of the first bluetooth module 120 and/or the floor location information about where the first bluetooth module 120 is located. The particular signal form of the first bluetooth signal is not restrictive.

In one embodiment, each personal mobile terminal 200 is configured to be able to automatically wake up from a sleep mode based on the received wake-up signal. For example, when a passenger carrying a personal mobile terminal 200 walks towards the elevator landing area 410, the personal mobile terminal 200 in a sleep mode will be able to receive a first bluetooth signal broadcasted by the first bluetooth module 120 (if the distance is close enough), especially a wake-up signal. At this moment, the personal mobile terminal 200 will be able to wake up from the sleep mode based on the wake-up signal, so as to make preparation for the automatic establishment of a first bluetooth connection.

It should be noted that when the personal mobile terminal 200 is in a sleep mode, it can receive a bluetooth signal, but it cannot automatically establish a bluetooth connection with the first bluetooth module 120/second bluetooth module 130, etc., and cannot automatically send an elevator calling request command or a target floor registration command either.

Each personal mobile terminal 200 can determine the signal strength of the first bluetooth signal received thereby, and in one embodiment, the personal mobile terminal 200 is configured with a received signal strength indicator (RSSI) for determining the signal strength of the first bluetooth signal or any other bluetooth signals received thereby.

In another embodiment, the first bluetooth module 120 may not broadcast a wake-up signal, and when the personal mobile terminal 200 cannot receive a wake-up signal, each personal mobile terminal 200 in sleep mode can also automatically wake up from a sleep mode when the signal strength of the first bluetooth signal received changes from relatively weak (e.g. 0) to equal to or greater than a first strength value.

Generally, the signal strength of the first bluetooth signal attenuates with the broadcast distance thereof, and therefore, the personal mobile terminal 200 that receives the first bluetooth signal can substantially determine the distance from the personal mobile terminal 200 to the first bluetooth module 120 according to the signal strength of the first bluetooth signal. It is to be understood that the distance changes dynamically as the passenger walks in the elevator landing area 410.

Figure 5:
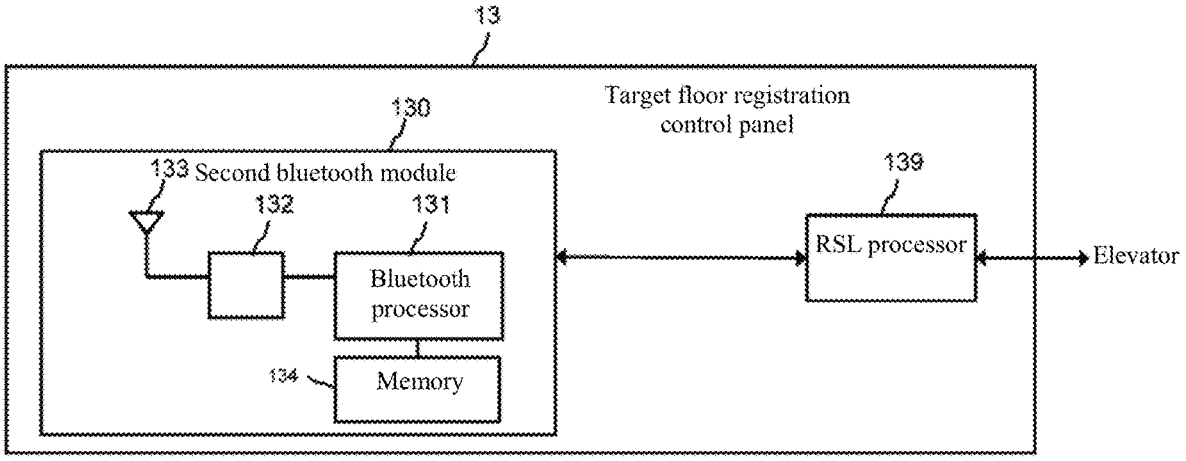
FIG. 5 is a structural schematic diagram of a target floor registration control panel according to one embodiment of the present invention.

Again, as shown in FIG. 1 and FIG. 3, the communication system 10 further includes a plurality of second bluetooth modules 130, and each second bluetooth module 130 is mounted in each elevator car 110, for example, one second bluetooth module 130-1 is arranged in the elevator car 110-1, and one second bluetooth module 130-2 is arranged in the elevator car 110-2. In one embodiment, the second bluetooth module is mounted on a target floor registration control panel 13 in the elevator car 110 (as shown in FIG. 5) and is integratedly arranged on the target floor registration control panel 13. The particular integration and arrangement manner of the second bluetooth module 130 with regard to the target floor registration control panel 13 is described thereafter in conjunction with FIG. 5.

The second bluetooth module 130 can particularly be a Bluetooth Low Energy (BLE) module. The second bluetooth signal broadcast or transmitted all along or persistently by the second bluetooth module 130 can substantially effectively cover the area in the elevator car 110 where it is installed. The first bluetooth signal can, for example, correspondingly be a bluetooth low energy signal, which can include a wake-up signal for waking up a personal mobile terminal 200 or can further include a data signal that reflects the UUID of the second bluetooth module 130 and/or the floor location information about where the second bluetooth module 130 is located. The particular signal form of the second bluetooth signal is not restrictive. However, it should be understood that it is possible to distinguish the second bluetooth signal from the first bluetooth signal by setting the particular signal form and/or signal strength of the second bluetooth signal and enable the personal mobile terminal 200 that receives the first bluetooth signal and/or the second bluetooth signal to distinctively recognize them.

Each personal mobile terminal 200 can determine the signal strength of the second bluetooth signal received thereby, and in one embodiment, the personal mobile terminal 200 is configured with a received signal strength indicator (RSSI) for determining the signal strength of the second bluetooth signal or any other bluetooth signals received thereby. Generally, the signal strength of the second bluetooth signal attenuates with the broadcast distance thereof, and therefore, the personal mobile terminal 200 that receives the second bluetooth signal can substantially determine the distance from the personal mobile terminal 200 to the second bluetooth module 120 according to the signal strength of the second bluetooth signal. It is to be understood that the distance changes dynamically as the passenger walks into the elevator car 110.

It should be noted that each first bluetooth module 120 and second bluetooth module 130 in the communication system 10 are coupled to an elevator controller 140, for example, they are coupled to the elevator controller 140 respectively through the elevator calling control panel 12 and the target floor registration control panel 13; therefore, the elevator calling request command and the elevator calling request command respectively received by the first bluetooth module 120 and the second bluetooth module 130 can be transmitted to the elevator controller 140.

Figure 2:
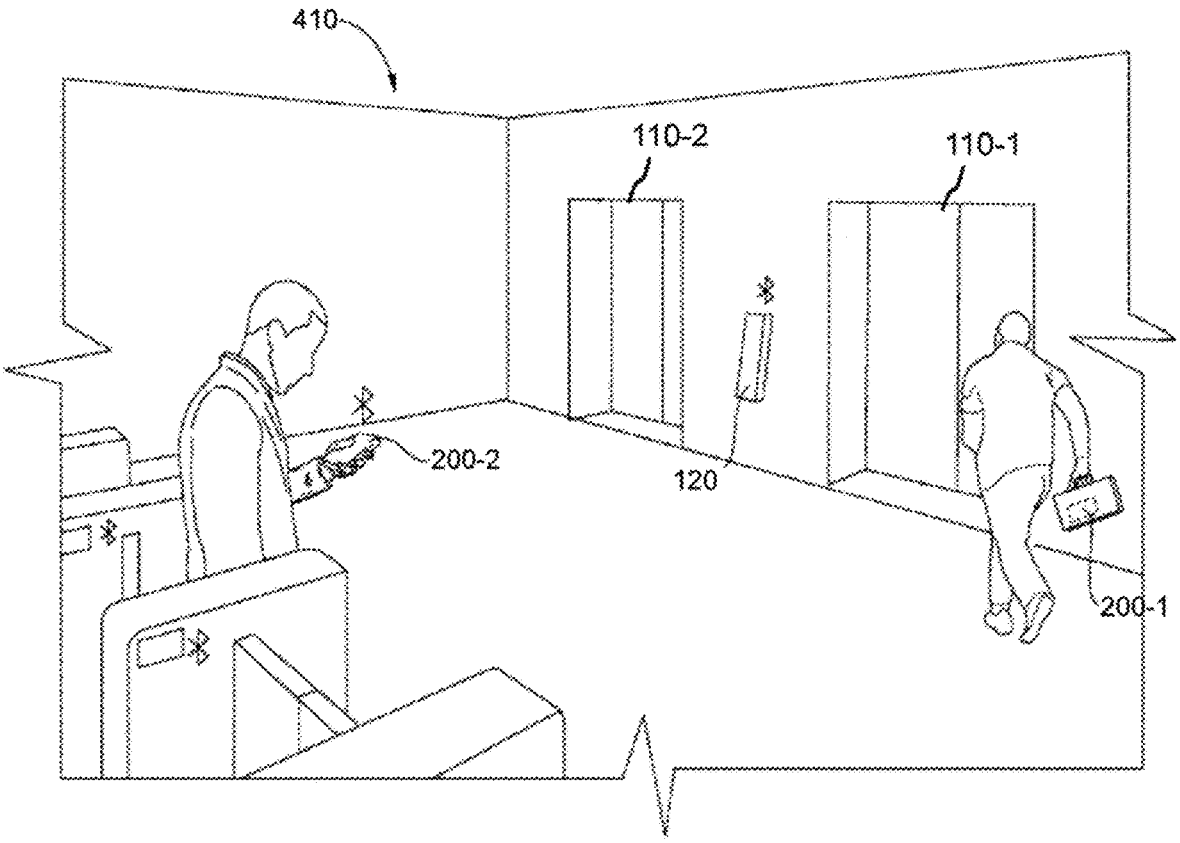
FIG. 2 is a schematic diagram of an application scenario of a communication system according to one embodiment of the present invention.

Again, as shown in FIG. 1 to FIG. 3, the communication system 10 further includes a personal mobile terminal 200 carried by a passenger, for example, personal mobile terminals 200-1 and 200-2 respectively carried by two passengers. Each personal mobile terminal 200 can establish a first bluetooth connection 320 with the first bluetooth module 120, and each personal mobile terminal 200 can establish a second bluetooth connection 330 with the second bluetooth module 130.

The personal mobile terminal 200 can be various smart terminals with a bluetooth connection function that are convenient for passengers to carry. For example, the personal mobile terminal 200 can be a smart phone, a wearable smart device (e.g., a smart bracelet), a personal digital assistant (PDA), etc., on which a corresponding application program (e.g. an APP) can be mounted to realize its function.

When a first bluetooth module 120 broadcasts a first bluetooth signal, a personal mobile terminal 200 carried by a passenger near the first bluetooth module 120 will be able to automatically receive the first bluetooth signal, and based on the first bluetooth signal, the personal mobile terminal 200 automatically establishes a first bluetooth connection 320 with the corresponding first bluetooth module 120; moreover, when establishing the first bluetooth connection, the personal mobile terminal 200 sends an elevator calling request command regarding an elevator calling direction (e.g., a " travel upward" or " travel downward" elevator calling request command), the first bluetooth module 120 receives the elevator calling request command regarding the elevator calling direction sent from the personal mobile terminal 200, and the first bluetooth module 120 can further send the elevator calling request command to the elevator controller 140, so that the elevator controller 140 controls the running of one or more elevator cars 110 in the elevator system 100 based on the elevator calling request command. The elevator calling request command automatically sent by the personal mobile terminal 200 can replace the elevator calling request command inputted by manually pressing the elevator calling button; moreover, the above process can be automatically realized without the need for the passenger to operate the personal mobile terminal 200 and is easy and convenient to realize.

Taking the application scenario shown in FIG. 2 as an example, when two passengers, for example, enters the elevator landing area 410 (e.g., a waiting area in a lobby), the personal mobile terminal 200-1 or 200-2 (e.g. a cell phone, whether in hand or in a hand bag) carried by them will automatically sense a first bluetooth signal sent by a first bluetooth module 120 mounted in the elevator landing area 410 (the personal mobile terminal 200-1 or 200-2 is close enough to the first bluetooth module 120), and thus establish a handshake connection with the first bluetooth module 120 based on the first bluetooth signal, namely establishing a first bluetooth connection 320; the personal mobile terminal 200-1 or 200-2 automatically sends an elevator calling request command regarding an elevator calling direction, and thus automatically completes the elevator calling request command without the need for the passenger to manually press the elevator calling button mounted on the elevator calling control panel 12 or manually operate the personal mobile terminal 200-1 or 200-2. Therefore, the present invention realizes that a passenger automatically inputs an elevator calling request command in the elevator system 100 in a hand free mode, greatly enhancing the passenger's experience.

It should be noted that each first bluetooth module 120 establishes a first bluetooth connection 320 with only one personal mobile terminal 200 at a certain moment, and each first bluetooth module 120 can successively establish a first bluetooth connection 320 with personal mobile terminals 200 carried by a plurality of passengers near the first bluetooth module 120. After establishing a first bluetooth connection 320 with the first bluetooth module 120 and sending a corresponding elevator calling request command, each personal mobile terminal 200 will actively disconnect the first bluetooth connection 320 so as to make preparation for the automatic establishment of a first bluetooth connection 320 between the first bluetooth module 120 and the personal mobile terminal 200 of the next passenger. In one embodiment, the first bluetooth module 120 is configured to return a first confirmation message to a corresponding personal mobile terminal 200 after receiving an elevator calling request command, and the first confirmation message indicates that the elevator calling request command is successfully accepted by the elevator system 100; and the personal mobile terminal 200 is configured to actively disconnect the first bluetooth connection 320 based on the first confirmation message received.

It should be noted that the "elevator calling request command regarding an elevator calling direction" does not contain the target floor information about the passenger, or the target floor information is not recognized or used by the elevator controller 140 even if it is contained. Therefore, in one embodiment of the present invention, a second bluetooth connection with the personal mobile terminal 200 is also established in dependence on the second bluetooth module 130.

Again, as shown in FIG. 1, when a second bluetooth module 130 broadcasts a second bluetooth signal, a personal mobile terminal 200 carried by a passenger near the second bluetooth module 130 will continue to be able to automatically receive the second bluetooth signal (at this moment, the first bluetooth connection previously established between the personal mobile terminal 200 and the first bluetooth module 120 has already been disconnected), and based on the second bluetooth signal, the personal mobile terminal 200 automatically establishes a second bluetooth connection 330 with the corresponding second bluetooth module 130; moreover, when establishing the second bluetooth connection 330, the personal mobile terminal 200 sends a target floor registration command about target floor information, the second bluetooth module 130 receives an elevator calling request command regarding an elevator calling direction sent from the personal mobile terminal 200, and the second bluetooth module 130 can further send the target floor registration command to the elevator controller 140, so that the elevator controller 140 controls the running of one or more elevator cars 110 in the elevator system 100 based on the target floor registration command. The target floor registration command automatically sent by the personal mobile terminal 200 can replace the target floor registration command inputted by manually pressing the floor button; moreover, the above process can be automatically realized without the need for the passenger to operate the personal mobile terminal 200, and is likewise easy and convenient to realize.

Taking the application scenario shown in FIG. 3 as an example, when a passenger enters the elevator car 110 for example, the personal mobile terminal 200 (e.g. a cell phone, whether in hand or in a hand bag) carried by him will automatically sense a second bluetooth signal sent by a second bluetooth module 130 mounted on the elevator car 110, and thus establish a handshake connection with the second bluetooth module 130 based on the second bluetooth signal, namely establishing a second bluetooth connection 330; the personal mobile terminal 200 automatically sends a target floor registration command containing target floor information, and thus automatically completes the target floor registration command without the need for the passenger to manually press the floor button mounted on the target floor registration control panel 13 or manually operate the personal mobile terminal 200. Therefore, the present invention realizes that a passenger automatically inputs a target floor registration command in the elevator system 100 in a hand free mode, greatly enhancing the passenger's experience.

It should be noted that each second bluetooth module 130 establishes a second bluetooth connection 330 with only one personal mobile terminal 200 at a certain moment, and each second bluetooth module 130 can successively establish a second bluetooth connection 330 with personal mobile terminals 200 carried by a plurality of passengers near the second bluetooth module 130. After establishing a second bluetooth connection 330 with the second bluetooth module 130 and sending a corresponding target floor registration command, each personal mobile terminal 200 will actively disconnect the second bluetooth connection 330 so as to make preparation for the establishment of a second bluetooth connection 330 between the second bluetooth module 130 and the personal mobile terminal 200 of the next passenger. In one embodiment, the second bluetooth module 130 is configured to return a second confirmation message to a corresponding personal mobile terminal 200 after receiving the target floor registration command, and the second confirmation message indicates that the target floor registration command is successfully accepted by the elevator system 100; and the personal mobile terminal 200 is configured to actively disconnect the second bluetooth connection 330 based on the second confirmation message received.

It should be understood that the above-mentioned process from establishing a first bluetooth connection to disconnecting the first bluetooth connection can be completed in a short time, and likewise, the above-mentioned process from establishing a second bluetooth connection to disconnecting the second bluetooth connection can also be completed in a short time, for example within a time range in the order of magnitude of milliseconds, so that one first bluetooth module 120 or second bluetooth module 130 can successively achieve a first bluetooth connection or a second bluetooth connection with many personal mobile terminals 200 in a short time, and the many personal mobile terminals 200 can complete an elevator calling operation substantially at the same time in a short time period.

It can be known in conjunction with the application scenarios shown in FIG. 2 and FIG. 3 that in the process that a certain passenger enters the lobby of a building and arrives at a target floor, as long as he/she carries a personal mobile terminal 200, he/she can take an elevator to the target floor without performing any operation, thereby greatly enhancing the passenger's experience.

It should be further noted that in the communication system 10 of the embodiments of the present invention, an elevator calling request command regarding an elevator calling direction and a target floor registration command are successively sent through a personal mobile terminal 200; moreover, they are also respectively transmitted to the first bluetooth module 120 and the second bluetooth module 130 successively based on the automatically established first bluetooth connection 320 and second bluetooth connection 330, realizing the separate operation of the input of the elevator calling request command regarding the elevator calling direction and the input of the target floor registration command. This elevator calling operation mode realized in the communication system 10 distinctively differs from another elevator calling operation mode, that is, automatically sending or automatically inputting an elevator calling request command regarding an elevator calling direction and target floor information once at the same time. In this elevator calling operation mode realized by the communication system 10 of the present application, when the elevator controller 140 of the elevator system 100 is performing scheduling control, it will not be and is not necessarily limited to assign a certain specified elevator car 110 to a passenger corresponding to a certain personal mobile terminal 200; therefore, when the passenger is waiting for an elevator at a certain elevator landing area 410, he/she will not need to take out the personal mobile terminal 200 to watch it and learn serial number information, etc. about the assigned elevator car 110, and as long as an elevator car 110 of which the running direction is consistent with the elevator calling direction arrives and the passenger walks in the elevator car 110, the registration of the target floor can be automatically realized. The whole process of taking the elevator completely eliminates the need for hand operation and fully realizes the effect of hand free.

While as a comparison, another elevator calling operation mode mentioned above obviously has the following deficiencies relative to the present application: in the first aspect, the elevator controller needs to perform scheduling control to assign a specified elevator car for the passenger and automatically register the target floor in the elevator car, and therefore, the serial number of a certain elevator car assigned needs to be sent to the passenger, and the passenger needs to watch and learn the serial number information about the assigned elevator car 110, thereby guiding the passenger to walk into the corresponding assigned elevator car, which has a high demand on the passenger but also realizes the effect of hand free; in the second aspect, once the passenger walks into a wrong elevator car (i.e., having failed to take the specified elevator car, which is easy to happen), the passenger needs to input target floor information by manually pressing the floor button in the elevator car, which is difficult to actually realize the effect of hand free; and in the third aspect, once the passenger walks into a wrong elevator car, the specified elevator car has already been registered with a target floor, and the specified elevator car will continue to operate according to the originally registered target floor information, enormously affecting the overall operating efficiency of the elevator system.

Moreover, the elevator system 100 of the embodiments of the present invention can be conveniently realized by reconstructing an existing elevator system, and has a low reconstruction cost, for example, arranging a first bluetooth module 120 of the present application on the elevator calling control panel by way of expansion, and arranging a second bluetooth module 130 of the present application on the target floor registration control panel by way of expansion, which can rapidly realize the reconstruction of an existing elevator with low costs. Below is the specific description of how to arrange the first bluetooth module 120 and the second bluetooth module 130 in the communication system 10 of the present invention in conjunction with FIG. 4 and FIG. 5.

Figure 4:
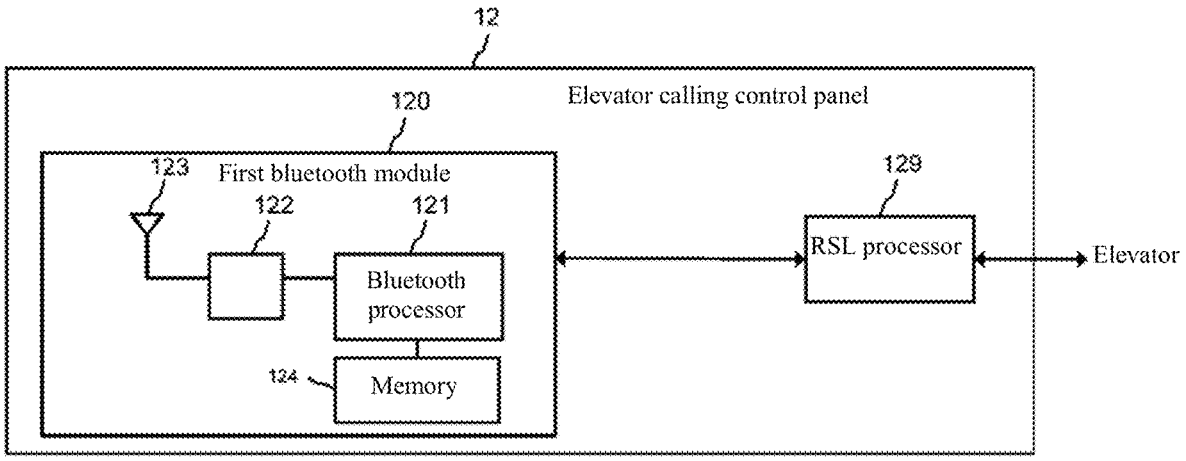
FIG. 4 is a structural schematic diagram of an elevator calling control panel according to one embodiment of the present invention.

Referring to FIG. 4, the first bluetooth module 120 of the embodiments of the present invention is integrated on the elevator calling control panel 12 of an elevator 100. The elevator calling control panel 12 is generally mounted in the elevator landing area 410, and in one embodiment, the elevator calling control panel 12 is connected with the elevator controller 140 via a bus, and an RSL (Remote Serial Link) communication connection is established between the elevator calling control panel 12 and the elevator controller 140 of the elevator system 100 based on, for example but not limited to, the RSL protocol; correspondingly, for example an RSL processor 129 can be arranged in the elevator calling control panel 12, and the RSL processor 129 can not only receive an elevator calling request command from the first bluetooth module 120, but also can receive an elevator calling request command corresponding to pressing an elevator calling button on the elevator calling control panel 12, and the elevator calling request command is processed according to the RSL protocol and then sent to the elevator controller 140.

The first bluetooth module 120 can particularly be realized by a bluetooth processor 121, a memory 124 and a bluetooth antenna 123, etc. The bluetooth antenna 123 can be used for receiving and broadcasting a bluetooth signal (for example, broadcasting a first bluetooth signal), and a filter 122 can be arranged between the bluetooth antenna 123 and the bluetooth processor 121 to filter the bluetooth signals. A corresponding program module can be configured or mounted on the memory 124 to realize the function of the first bluetooth module 120 of the present invention, and the memory 124 can also set or store, for example, the UUID of the first bluetooth module 120 and/or the floor location information about where the first bluetooth module 120 is located, etc. The bluetooth processor 121 of the first bluetooth module 120 can establish a corresponding communication connection with the RSL processor 129 of the elevator calling control panel 12 while working, for example a serial port connection established based on a Universal Asynchronous Receiver/Transmitter (UART). When the first bluetooth module 120 is working, the bluetooth processor 121 and the RSL processor 129 shake hands and constantly perform communication connection verification. As such, an elevator calling request command obtained by the first bluetooth module 120 can be transmitted, in real time, to the RSL processor 129 of the elevator calling control panel 12 for processing, and then be sent, in real time, to the elevator controller 140. It is to be understood that when transmitting the elevator calling request command to the RSL processor 129, the first bluetooth module 120 can also transmit, for example, the UUID and/or floor location information, etc. pre-stored in the memory 124.

In one embodiment, the elevator calling request command, etc. received by the first bluetooth module 120 can be recorded in the memory 140, the bluetooth processor 121 of the first bluetooth module 120 can send out an instruction to the RSL processor 129, and then further to the elevator controller 140, so as to read information stored in the elevator controller 140 or the elevator system 100, e.g., running state information, running historical status information, repairing or maintenance record information, and so on, which can be the results of beforehand analysis and processing; after obtaining these pieces of information, the first bluetooth module 120 can wirelessly transmit these pieces of information to a digital terminal (which can be for example a cell phone, a personal digital assistant) carried by a staff such as a maintenance staff through the bluetooth antenna 123, and at this moment, the digital terminal has already been authorized to establish a bluetooth connection with the first bluetooth module 120. Consequently, it is convenient for the maintenance staff to rapidly and conveniently acquire some information about the elevator system 100 at the elevator landing area 410, for example, information required for daily maintenance work, information required for repairing the elevator, etc. Therefore, through the first bluetooth module 120 of the embodiments of the present invention integrated in the elevator calling control panel 12, the information stored in the elevator system 100 can be conveniently acquired at the elevator landing area 410, which is convenient for the daily maintenance or repairing of the elevator system 100.

Referring to FIG. 5, a second bluetooth module 130 of the embodiments of the present invention is integrated on the target floor registration control panel 13 of the elevator 100. The target floor registration control panel 13 is generally mounted in the elevator car 110, and in one embodiment, the target floor registration control panel 13 is connected with the elevator controller 140 via a bus, and an RSL (Remote Serial Link) communication connection is established between the target floor registration control panel 13 and the elevator controller 140 of the elevator system 100 based on, for example but not limited to, an RSL protocol; correspondingly, for example an RSL processor 139 can be arranged in the target floor registration control panel 13, and the RSL processor 139 can not only receive a target floor registration command from the second bluetooth module 130, but also can receive a target floor registration command corresponding to pressing a floor button on the target floor registration control panel 13, and the target floor registration command is processed according to the RSL protocol and then sent to the elevator controller 140. The second bluetooth module 130 can particularly be realized by a bluetooth processor 131, a memory 134 and a bluetooth antenna 133, etc. The bluetooth antenna 133 can be used for receiving and broadcasting a bluetooth signal (for example, broadcasting a first bluetooth signal), and a filter 132 can be provided between the bluetooth antenna 133 and the bluetooth processor 131 to filter the bluetooth signal. A corresponding program can be arranged or mounted on the memory 134 to realize the function of the second bluetooth module 130 of the present invention, and the memory 124 can also set or store, for example, the UUID of the second bluetooth module 130 and/or the elevator car where the second bluetooth module 130 is located, etc. The bluetooth processor 131 of the second bluetooth module 130 can establish a corresponding communication connection with the RSL processor 139 of the target floor registration control panel 13 while working, for example a serial port connection established based on a UART. When the second bluetooth module 130 is working, the bluetooth processor 131 and the RSL processor 139 shake hands and constantly perform communication connection verification. As such, a target floor registration command obtained by the second bluetooth module 130 can be transmitted, in real time, to the RSL processor 139 of the target floor registration control panel 13 for processing, and then be sent, in real time, to the elevator controller 140.

Figure 6:
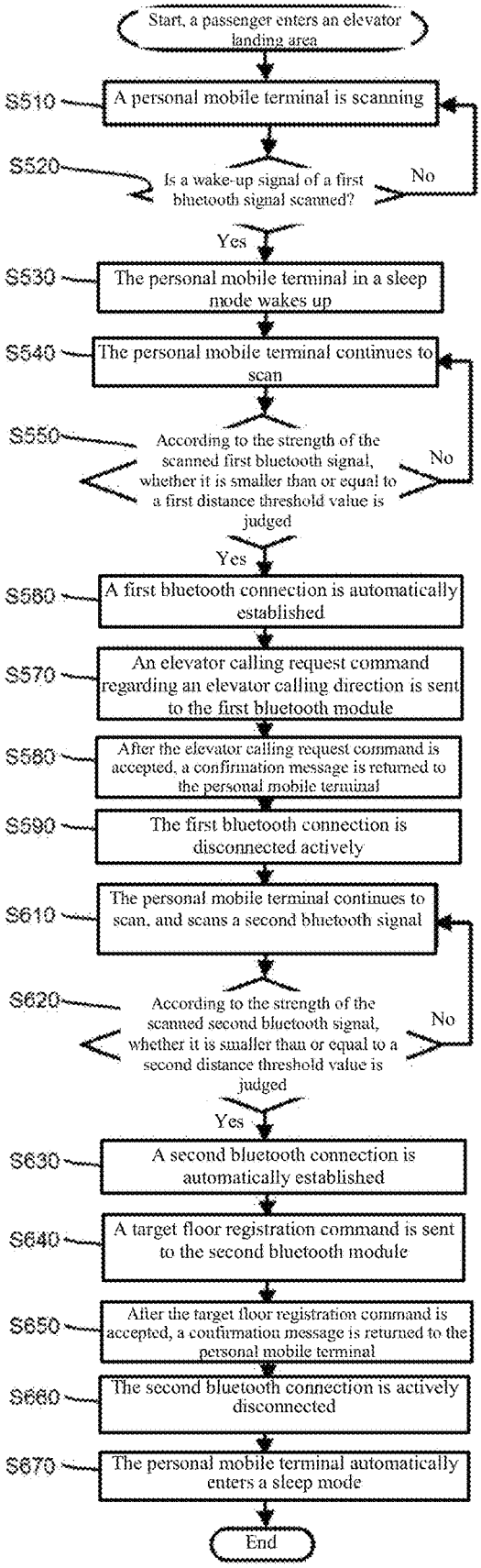
FIG. 6 is a flowchart of a communication method for performing an elevator calling operation according to one embodiment of the present invention.

FIG. 6 shows a flowchart of a communication method for performing an elevator calling operation according to one embodiment of the present invention. The communication method of the embodiments of the present invention is described below in conjunction with FIG. 1 to FIG. 6. Also exemplified is how a passenger carrying a personal mobile terminal 200 performs an elevator calling operation based on the communication method.

Firstly, the passenger carrying the personal mobile terminal 200 enters a certain elevator landing area 410, and the personal mobile terminal 200 approaches a first bluetooth module 120 mounted in the elevator landing area 410. In this process, the personal mobile terminal 200 is in a sleep mode, and the personal mobile terminal 200 can constantly scan bluetooth signals, i.e., step S510. Moreover, whether a wake-up signal in a first bluetooth signal broadcasted by the first bluetooth module 120 mounted in the elevator landing area 410 is scanned is judged, i.e., step S520, until a determination result is "yes"; and step S530 is entered to wake up the personal mobile terminal 200 in the sleep mode.

It should be noted that the personal mobile terminal 200 is not limited to using the received wake-up signal to wake up the personal mobile terminal 200 in the sleep mode; in another embodiment, when the personal mobile terminal 200 scans a first bluetooth signal broadcasted by the first bluetooth module 120, the signal strength of the first bluetooth signal that is scanned will be determined at the same time, and enables the personal mobile terminal 200 to automatically wake up from the sleep mode if the signal strength of the first bluetooth signal changes from relatively weak to equal to or greater than a first strength value; in yet another embodiment, when the personal mobile terminal 200 scans a first bluetooth signal broadcasted by the first bluetooth module 120, the signal strength of the first bluetooth signal that is scanned will be determined at the same time, and the current distance from the personal mobile terminal 200 to the first bluetooth module 120 will be roughly determined based on the magnitude of the signal strength, so as to enable the personal mobile terminal 200 to automatically wake up from the sleep mode when the distance from the personal mobile terminal 200 to the first bluetooth module 120 is smaller than or equal to a certain predetermined value (e.g., a first distance threshold value). Further, in step S540, the personal mobile terminal 200 continues to scan so as to continue to receive the first bluetooth signal broadcasted by the first bluetooth module 120. In this step, as the passenger has the need to take the elevator, the personal mobile terminal 200 may be constantly approaching the first bluetooth module 120.

Further, in step S550, whether the current distance between the personal mobile terminal 200 and the first bluetooth module 120 is smaller than or equal to a first distance threshold value is judged according to the signal strength of the first bluetooth signal scanned. In this step, in one embodiment, the personal mobile terminal 200 can determine the current distance between the personal mobile terminal 200 and the first bluetooth module 120 according to the signal strength of the first bluetooth signal scanned, so as to judge whether the distance is smaller than or equal to the first distance threshold value according to the pre-entered or pre-determined first distance threshold value, wherein the first distance threshold value can specifically be selected and set according to the signal strength of the first bluetooth signal broadcasted by the first bluetooth module 120, the specific architectural structure of the elevator landing area, etc., for example, in the range of 3 to 20 meters, thus reflecting, as accurately as possible, that a passenger in the range smaller than or equal to the first distance threshold value indeed has the intention to take the elevator (i.e., having an elevator calling need).

It should be noted that in another embodiment, whether to establish a second bluetooth connection can be judged directly based on the signal strength of the second bluetooth signal scanned, and specifically, the personal mobile terminal 200 can judge, according to the signal strength of the second bluetooth signal scanned, whether the signal strength changes from relatively weak (e.g., 0) to equal to or greater than a second strength value, and the second strength value can correspondingly be, for example, a signal strength value of the corresponding second bluetooth signal in the case of the second distance threshold value.

If a determination result is "no", step S540 is returned to, to continue scanning; if a determination result "yes", step S560 is entered, to automatically establish a first bluetooth connection between the first bluetooth module 120 and the personal mobile terminal 200; at this moment, the first bluetooth module 120 can send a data signal to the personal mobile terminal 200, for example, a data signal that reflects the UUID of the first bluetooth module 120, a data signal that reflects the floor location information about where the first bluetooth module is located, etc., so that the personal mobile terminal 200 can learn to which first bluetooth module 120 it is connected and automatically acquire the floor location information about where it is currently located.

Further, in step S570, an elevator calling request command regarding an elevator calling direction is sent to the first bluetooth module 120. In step S570, the first bluetooth module 120 simultaneously receives the elevator calling request command, and after receiving the elevator calling request command, as shown in FIG. 4, the RSL processor 129 in the elevator calling control panel 12 can process the elevator calling request command and then transmit same to the elevator controller 140 via a bus, and of course can transmit the floor location information, etc. to the elevator controller 140.

Further, in step S580, after the elevator calling request command is successfully accepted, a confirmation message is returned to the personal mobile terminal 200. If the elevator calling request command is successfully accepted by the elevator controller 140, i.e., the elevator controller 140 will control the running of one or more elevator cars 110 in the elevator system 10 based on the elevator calling request command, then the elevator controller 140 will return a confirmation message to the RSL processor 129, and the confirmation message is further returned to the first bluetooth module 120 and is further returned to the personal mobile terminal 200.

Further, in step S590, after receiving the confirmation message, the personal mobile terminal 200 actively disconnects the first bluetooth connection, to make preparation for the establishment of a connection between the personal mobile terminal 200 and the second bluetooth module 130, and also make preparation for the establishment of a first bluetooth connection between the first bluetooth module 120 and other personal mobile terminals 200.

Further, in step S610, the personal mobile terminal 200 continues to scan, and the signal strength of the second bluetooth signal broadcasted by the second bluetooth module 130 is weaker relative to the first bluetooth signal, and if the elevator car 110 corresponding to the second bluetooth module 130 arrives at the elevator landing area 410 and the personal mobile terminal 200 is close enough relative to the second bluetooth module 130, then the personal mobile terminal 200 will scan the second bluetooth signal, for example, the passenger carrying the personal mobile terminal 200 is walking into the elevator car 110 or has already walked into the elevator car 110, and the second bluetooth signal can be scanned.

Further, in step S620, whether the current distance between the personal mobile terminal 200 and the second bluetooth module 130 is smaller than or equal to a second distance threshold value is judged according to the signal strength of the second bluetooth signal scanned. In this step, the personal mobile terminal 200 can determine the current distance between the personal mobile terminal 200 and the second bluetooth module 130 according to the signal strength of the second bluetooth signal scanned, so as to be able to judge whether the distance is smaller than or equal to a second distance threshold value according to the pre-entered or pre-determined second distance threshold value, wherein the second distance threshold value can specifically be selected and set according to the signal strength of the second bluetooth signal broadcasted by the second bluetooth module 130, the size of the elevator car 110, etc. Optionally, the second distance threshold value is smaller than the first distance threshold value, and the second distance threshold value is set in the range of 0.7 to 1 meter, so as to avoid firstly establishing a second bluetooth connection and then establishing a first bluetooth connection when a passenger enters the elevator landing area 410, and it can also be avoided as far as possible that the personal mobile terminal 200 of a passenger who is outside the elevator car 110 and is definitely not intending to take the elevator car 110 establishes a second bluetooth connection with the second bluetooth module 130. By setting the size of the second distance threshold value, it is possible to reflect, as accurately as possible, whether a passenger in the range smaller than or equal to the second distance threshold value is walking into the elevator car 110 or has already walked into the elevator car 110.

It should be noted that in another embodiment, whether to establish a second bluetooth connection can be judged directly based on the signal strength of the second bluetooth signal scanned, and specifically, the personal mobile terminal 200 can judge, according to the signal strength of the second bluetooth signal scanned, whether the signal strength changes from relatively weak (e.g., 0) to equal to or greater than a second strength value, and the second strength value can correspondingly be, for example, a signal strength value of the corresponding second bluetooth signal in the case of the second distance threshold value.

If a determination result is "no", step S610 is returned to, to continue scanning; if a determination result is "yes", step S630 is entered, to automatically establish a second bluetooth connection between the second bluetooth module 130 and the personal mobile terminal 200; at this moment, the second bluetooth module 130 can send a data signal to the personal mobile terminal 200, for example, a data signal that reflects the UUID of the second bluetooth module 130, a data signal that reflects the floor location information about where the second bluetooth module 130 is located, so that the personal mobile terminal 200 can learn to which second bluetooth module 130 it is connected and in which elevator car 110 it is located.

Further, in step S640, a target floor registration command is sent to the second bluetooth module 130. In step S640, the second bluetooth module 130 simultaneously receives the target floor registration command, and after receiving the target floor registration command, as shown in FIG. 5, the RSL processor 139 in the target floor registration control panel 13 can process the target floor registration command and then transmit same to the elevator controller 140 via a bus.

Further, in step S650, after the target floor registration command is successfully accepted by the elevator system 100, a confirmation message is returned to the personal mobile terminal 200. If the target floor registration command is successfully accepted by the elevator controller 140, i.e., the elevator controller 140 will control the operation of the elevator car 110 based on the target floor registration command, then the elevator controller 140 will return a confirmation message to the RSL processor 139, and the confirmation message is further returned to the second bluetooth module 130 and further returned to the personal mobile terminal 200.

Further, in step S660, after receiving the confirmation message, the personal mobile terminal 200 actively disconnects the second bluetooth connection, to make preparation for the establishment of a second bluetooth connection between the second bluetooth module 130 and other personal mobile terminals 200. At this moment, the elevator calling operation of the passenger has already been completed, and the passenger will be carried to the floor corresponding to the target floor registration command.

Further, in step S670, the personal mobile terminal 200 automatically enters a sleep mode.

So far, the process of a communication method corresponding to a personal mobile terminal 200 and an elevator system 100 is basically completed. However, it is to be understood that the first bluetooth module 120 and the second bluetooth module 130 of the elevator system 100 can successively perform the above communication process with other personal mobile terminals 200; for example, after a plurality of passengers carrying personal mobile terminals 200 enter the elevator landing area 130, the above steps S510 to S590 can be realized successively so that each passenger can complete the elevator calling operation in the elevator landing area; and after the plurality of passengers carrying personal mobile terminals 200 enter the elevator car 110, the above steps S610 to S670 can be realized successively so that each passenger can complete the elevator calling operation in the elevator car. Therefore, in this embodiment, the first bluetooth module 120 establishes a first bluetooth connection with only one personal mobile terminal 200 at a certain moment, and likewise, the second bluetooth module 130 establishes a second bluetooth connection with only one personal mobile terminal 200 at a certain moment; and moreover, it is to be understood that the time length for performing the above steps S560 to S590 each time and the time length for performing the above steps S630 to S660 each time can be controlled, for example, in the order of magnitude of milliseconds, so as to satisfy the need that more passengers complete elevator calling operations basically at the same time in a shorter time period.

Figure 7:
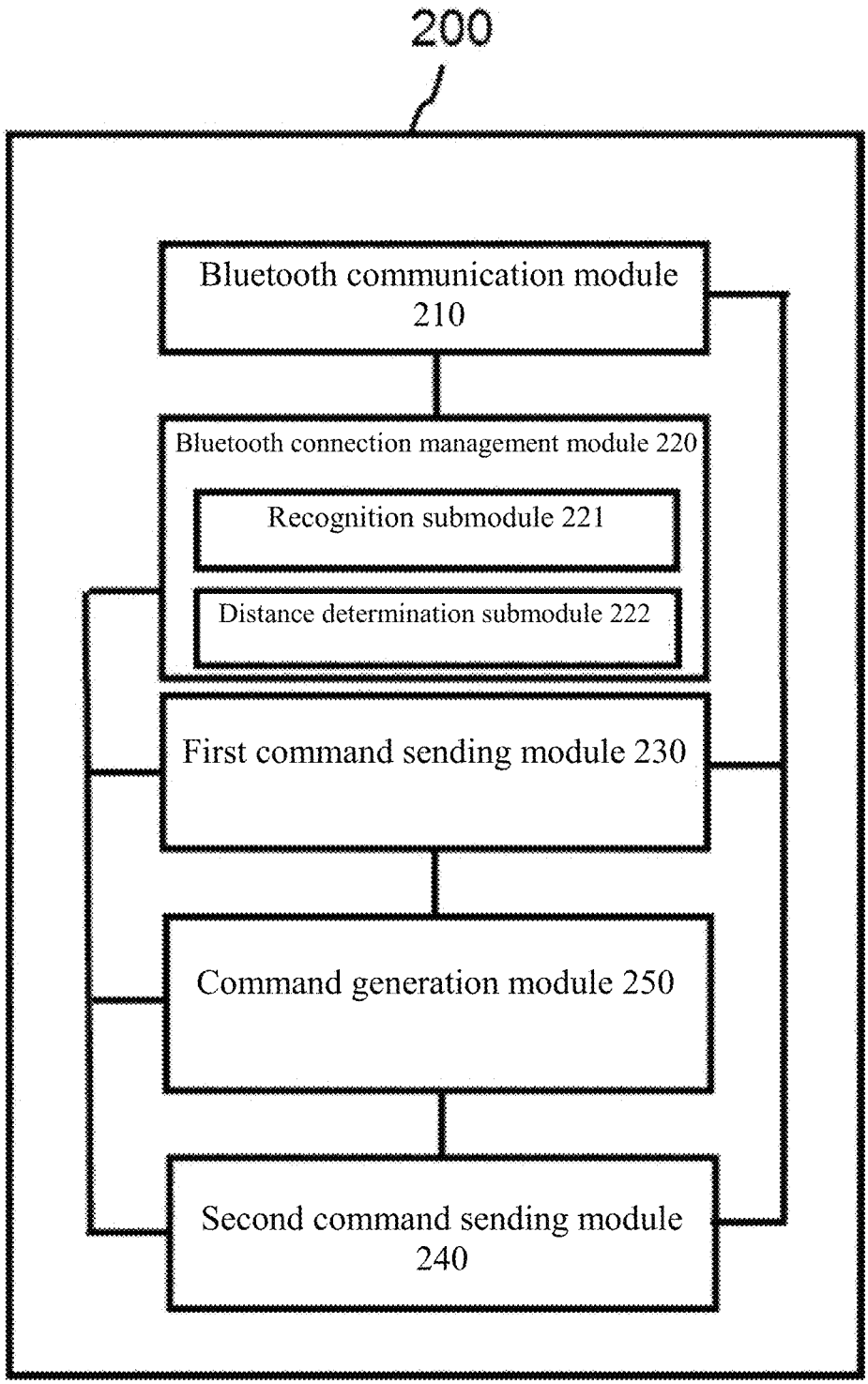
FIG. 7 is a structural schematic diagram of modules of a personal mobile terminal according to one embodiment of the present invention.

FIG. 7 is a structural schematic diagram of a module of a personal mobile terminal according to one embodiment of the present invention. As shown in FIG. 7, the personal mobile terminal 200 is applied in the communication system 10 as shown in FIG. 1, and is configured to be able to receive a first bluetooth signal broadcasted by the first bluetooth module 120 mounted in the elevator landing area 410 of the elevator system 100 and be able to receive a second bluetooth signal broadcasted by the second bluetooth module 130 mounted in the elevator car 110 of the elevator system 100. For example, the personal mobile terminal 200 is configured with a bluetooth communication module 210 to receive the first bluetooth signal or the second bluetooth signal.

As shown in FIG. 7, the personal mobile terminal 200 is provided with a bluetooth connection management module 220 for successively automatically establishing the first bluetooth connection and the second bluetooth connection respectively based on the first bluetooth signal and the second bluetooth signal. The specific process and principle for automatically establishing the first bluetooth connection are exemplified in the above description corresponding to steps S510 to S560 in FIG. 6. In one embodiment, the bluetooth connection management module 220 is configured to automatically establish a bluetooth connection with only one of the first bluetooth module 120 and the second bluetooth module 130 at a certain moment; as an example, if the bluetooth connection management module 220 can scan the first bluetooth signal and the second bluetooth signal at the same time, the bluetooth connection management module 220 selects only one of them to establish a corresponding bluetooth connection, wherein the second bluetooth connection can only be established after the first bluetooth connection which is earlier established is disconnected.

In one embodiment, the bluetooth connection management module 220 is also configured to automatically establish the first bluetooth connection when signal strength of the first bluetooth signal it receives changes from relatively weak to equal to or greater than a first strength value, and/or automatically establish the second bluetooth connection when signal strength of the second bluetooth signal it receives changes from relatively weak to equal to or greater than a second strength value. Here, the first strength value can be determined in advance according to factors like the signal strength of the first bluetooth signal broadcast, the structure of the elevator landing area 410, etc., and the second strength value can be determined in advance according to factors like the signal strength of the second bluetooth signal broadcast.

In one embodiment, the bluetooth connection management module 220 is provided with a recognition submodule 221, wherein the recognition submodule 221 is used for recognizing the first bluetooth signal and determining a floor location where the first bluetooth module is located; in one example, the first bluetooth signal broadcasted by the first bluetooth module 120 includes the UUID thereof, and by recognizing the UUID, the recognition submodule 221 can recognize which specific bluetooth module broadcasts the first bluetooth signal, and can even recognize the floor location information about where the first bluetooth module is located; and in another example, the first bluetooth signal broadcasted by the first bluetooth module 120 also includes a data signal containing the floor location information about where the first bluetooth module is located, and by recognizing the data signal, the floor location information about where the first bluetooth module is located can be determined.

In one embodiment, the bluetooth connection management module 220 is also provided with a distance determination submodule 222. When a personal mobile terminal 200 receives a first bluetooth signal, the distance determination submodule 222 can roughly determine the distance from the personal mobile terminal 200 to the first bluetooth module 120 according to the signal strength of the first bluetooth signal; likewise, when a personal mobile terminal 200 receives a second bluetooth signal, the distance determination submodule 222 can roughly determine the distance from the personal mobile terminal 200 to the second bluetooth module 120 according to the signal strength of the second bluetooth signal. The distance determination submodule 222 can automatically establish the first bluetooth connection when the distance from the personal mobile terminal 200 to the first bluetooth module 120 is smaller than or equal to a first distance threshold value.

The bluetooth connection management module 220 can manage bluetooth connections based on the result obtained by the recognition submodule 221 and/or the distance determination submodule 222, for example, judging, according to the determined distance, whether the distance between the current personal mobile terminal 200 and the first bluetooth module 120 or the second bluetooth module 130 is smaller than or equal to a corresponding first distance threshold value or second distance threshold value, so as to determine whether to establish a first bluetooth connection or a second bluetooth connection. The bluetooth connection management module 220 can specifically set the size of the first distance threshold value and the size of the second distance threshold value, and the first distance threshold value is generally obviously greater than the second distance threshold value, for example, the first distance threshold value is set in the range of 3 to 20 meters, and the second distance threshold value is set in the range of 0.7 to 1 meter. As such, the bluetooth connection management module 220 can avoid simultaneously establishing the first bluetooth connection and the second bluetooth connection. Moreover, the bluetooth connection management module 220 can also be used for managing the automatic disconnection of the first bluetooth connection or the second bluetooth connection, for example, automatically disconnecting the first bluetooth connection after the personal mobile terminal 200 has already sent out an elevator calling request command, and automatically disconnecting the second bluetooth connection after the personal mobile terminal 200 has already sent out a target floor registration command.

Again, as shown in FIG. 7, the personal mobile terminal 200 is also provided with a first command sending module 230 for automatically sending an elevator calling request command regarding an elevator calling direction to a corresponding first bluetooth module 120 when establishing the first bluetooth connection; as an example, if the recognition submodule 221 acquires the floor location information about where the first bluetooth module 120 is located, e.g., the lobby floor, an "upward" elevator calling request command can be sent according to a beforehand elevator calling request command setting, so as to replace the action of manually pressing the " upward" elevator calling button.

Again, as shown in FIG. 7, the personal mobile terminal 200 is also provided with a second command sending module 240 for automatically sending a target floor registration command to a corresponding second bluetooth module 130 when establishing the second bluetooth connection; as an example, if the recognition submodule 221 acquires the floor location information about where the first bluetooth module 120 is located, e.g., the lobby floor, a target floor that the passenger might most possibly want to go to can be determined according to a beforehand target floor registration setting, and a corresponding target floor registration command can be sent, so as to replace the action of manually pressing the floor button in the elevator car.

The commands sent by the first command sending module 230 and the second command sending module 240 can be sent out in the form of bluetooth signals through the bluetooth communication module 210, for example, sent to the first bluetooth module 120 through a first bluetooth connection channel established, sent to the second bluetooth module 130 through a second bluetooth connection channel established.

Again, as shown in FIG. 7, in one embodiment, the personal mobile terminal 200 is also provided with a command generation module 250 which generates an elevator calling request command and/or a target floor registration command based on a personalized configuration, so as to be able to generate an accurate elevator calling request command or a target floor registration command according to the passenger's condition. As an example, a passenger corresponding to the personal mobile terminal 200 is carrying out daily work or life on the Nth floor of an office building or a residential building, and the passenger can enter the Nth floor in the command generation module 250 and go to the Nth floor by completing the hand-free automatic elevator calling operation through the personal mobile terminal 200 by default, i.e., entering a personalized configuration; if the passenger is currently located at the elevator landing area 410 of the (N−x)th floor (which can be acquired through the recognition submodule 221), then the command generation module 250 will automatically generate an "upward" elevator calling request command and provide same to the first command sending module 230 for sending, and at the same time can also generate a target floor registration command corresponding to the Nth floor and provide same to the second command sending module 240 for sending; and if the passenger is currently located at the elevator landing area 410 of the (N+y)th floor (which can be acquired through the recognition submodule 221), then the command generation module 250 will automatically generate a "downward" elevator calling request command and provide same to the first command sending module 230 for sending, and at the same time can also generate a target floor registration command corresponding to the Nth floor and provide same to the second command sending module 240 for sending.

If the passenger enters a plurality of floors in the command generation module 250 and goes to any one of the plurality of floors by completing the hand-free automatic elevator calling operation through the personal mobile terminal 200 by default, then a personalized configuration can be entered according to the set time period, the condition of the floor where he/she is currently located, etc., to generate an accurate elevator calling request command and/or target floor registration command.

It should be noted that the personal mobile terminal 200 of the above embodiments of the present invention can be realized by computer program instructions, for example, by a dedicated APP, and these computer program instructions can be provided to a processor of a general-purpose computer, a special-purpose computer or other programmable data processing devices, to constitute a personal mobile terminal 200 of the embodiments of the present invention. Moreover, the processor of a computer or other programmable data processing devices can execute these instructions to create a unit or part for implementing functions/operations specified in these flowcharts and/or blocks and/or one or more flow block diagrams.

Likewise, the first bluetooth module 120 and the second bluetooth module 130 of the elevator system 100 of the above embodiments of the present invention can be realized by computer program instructions, for example, by a dedicated program, and these computer program instructions can be provided to a processor to constitute a control module 300 of the embodiments of the present invention. Moreover, these instructions executed by the processor of a computer or other programmable data processing devices can be used to create a unit or part for implementing functions/operations specified in these flowcharts and/or blocks and/or one or more flow block diagrams.

Moreover, these computer program instructions can be stored in a computer readable memory, these instructions can instruct the computer or other programmable processors to realize functions in a specific way, so that these instructions stored in the computer readable memory construct a manufacturing product that contains an instruction part for implementing the functions/operations specified in one or more blocks of the flowcharts and/or block diagrams.

It should also be noted that in some alternative implementation manners, the functions/operations shown in the blocks may not happen in the sequence shown in the flowchart. For example, two blocks that are successively shown can be executed substantially at the same time in fact, or these blocks sometimes can be executed in a reversed order, depending on the involved function/operation in particular.

It should be noted that the elements (including flowcharts and block diagrams in the accompanying drawings) disclosed and depicted in this specification refer to the logic boundary between elements. However, according to the software or hardware engineering practice, the depicted elements and the functions thereof can be executed on a machine through a computer executable medium, the computer executable medium has a processor that can execute program instructions stored thereon, and the program instructions serve as a monolithic software structure, as an independent software module or as a module using external programs, code, services, etc., or any combination of them, and all these execution solutions may fall in the scope of the present disclosure.

Although different non-restrictive embodiments have specifically described components, the embodiments of the present invention are not limited to these specific combinations. Some of the components or features from any non-restrictive embodiments can be used in combination with the features or components of any other non-restrictive embodiments.

Although a specific step sequence is shown, disclosed and claimed, it should be understood that the steps can be implemented, separated or combined in any order, and will still benefit from the present disclosure, unless otherwise specified.

The previous description is exemplary but is not defined to be limited thereto. This specification discloses various non-restrictive embodiments. However, a person of ordinary skill in the art will be aware that various modifications and changes will fall in the scope of the accompanying claims according to the above-mentioned teachings. Therefore, it is to be understood that the disclosed content, except for the specific disclosure, can be implemented in the scope of the accompanying claims. For this reason, it is necessary to study the accompanying claims to determine the actual scope and content.

What is claimed is:

1. A communication system for use in an elevator system, wherein the communication system comprises:

a first bluetooth module for broadcasting a first bluetooth signal and automatically establishing a first bluetooth connection with a personal mobile terminal based on the first bluetooth signal, and receiving an elevator calling request command regarding an elevator calling direction sent from the personal mobile terminal when establishing the first bluetooth connection;

a second bluetooth module for broadcasting a second bluetooth signal and automatically establishing a second bluetooth connection with the personal mobile terminal based on the second bluetooth signal, and receiving a target floor registration command sent from the personal mobile terminal when establishing the second bluetooth connection;

wherein the first bluetooth module is mounted in an elevator landing area of the elevator system, and the second bluetooth module is mounted in an elevator car of the elevator system;

wherein the first bluetooth module is further configured to return a first confirmation message to the personal mobile terminal after receiving the elevator calling request command;

wherein the personal mobile terminal is further configured to actively disconnect the first bluetooth connection based on the first confirmation message received;

wherein the second bluetooth module is further configured to return a second confirmation message to the personal mobile terminal after receiving the target floor registration command;

wherein the personal mobile terminal is further configured to actively disconnect the second bluetooth connection based on the second confirmation message received; and wherein the first confirmation message indicates that the elevator calling request command is successfully accepted by the elevator system, and the second confirmation message indicates that the target floor registration command is successfully accepted by the elevator system.

2. The communication system as claimed in claim 1, characterized in that the personal mobile terminal is configured to automatically establish the first bluetooth connection or the second bluetooth connection with only one of the first bluetooth module and the second bluetooth module at a certain moment.

3. The communication system as claimed in claim 2, characterized in that the personal mobile terminal is further configured to automatically establish the second bluetooth connection with the second bluetooth module after the first bluetooth connection previously established thereby with the first bluetooth module is disconnected.

4. The communication system as claimed in claim 2, characterized in that the personal mobile terminal is further configured to automatically establish the first bluetooth connection when a signal strength of the first bluetooth signal received thereby changes from relatively weak to equal to or greater than a first strength value; and/or automatically establish the second bluetooth connection when a signal strength of the second bluetooth signal received thereby changes from relatively weak to equal to or greater than a second strength value.

5. The communication system as claimed in claim 2, characterized in that the personal mobile terminal is further configured to substantially determine a distance from the personal mobile terminal to the first bluetooth module according to a signal strength of the first bluetooth signal received thereby, and automatically establish the first bluetooth connection when the distance is smaller than or equal to a first distance threshold value; and/or substantially determine a distance from the personal mobile terminal to the second bluetooth module according to a signal strength of the second bluetooth signal received thereby, and automatically establish the second bluetooth connection when the distance is smaller than or equal to a second distance threshold value.

6. The communication system as claimed in claim 5, characterized in that the second distance threshold value is equal to or greater than 0.7 meter and is smaller than or equal to 1 meter, and the first distance threshold value is greater than the second distance threshold value.

7. The communication system as claimed in claim 4, characterized in that the personal mobile terminal is further configured to automatically wake up from a sleep mode when the signal strength of the first bluetooth signal received thereby changes from relatively weak to equal to or greater than the first strength value.

8. The communication system as claimed in claim 4, characterized in that the personal mobile terminal is further configured to automatically wake up from a sleep mode when the distance therefrom to the first bluetooth module is smaller than or equal to the first distance threshold value.

9. The communication system as claimed in claim 1, characterized in that the first bluetooth module is configured to respectively establish the first bluetooth connection with a plurality of personal mobile terminals in sequence; and/or the second bluetooth module is configured to respectively establish the second bluetooth connection with a plurality of personal mobile terminals in sequence.

10. The communication system as claimed in claim 1, characterized in that the personal mobile terminal is further configured to automatically enter a sleep mode after the second bluetooth connection is disconnected.

11. The communication system as claimed in claim 1, characterized in that the first bluetooth signal and/or the second bluetooth signal comprise(s) a wake-up signal for waking up the personal mobile terminal, and the personal mobile terminal is further configured to automatically wake up from the sleep mode after receiving the wake-up signal.

12. The communication system as claimed in claim 1, characterized in that the first bluetooth signal comprises a data signal that reflects a universally unique identifier of the first bluetooth module and/or first floor location information about where the first bluetooth module is located; and/or the second bluetooth signal comprises a data signal that reflects a universally unique identifier of the second bluetooth module and/or second floor location information about where the second bluetooth module is located.

13. The communication system as claimed in claim 1, characterized in that the first bluetooth module and/or the second bluetooth module are/is bluetooth low energy modules/a bluetooth low energy module.

14. The communication system as claimed in claim 1, characterized in that the first bluetooth module is integratedly arranged in an elevator calling control panel of the elevator system, wherein a first communication connection is established between the elevator calling control panel and an elevator controller of the elevator system, and a second communication connection is established between the first bluetooth module and the elevator calling control panel; and/or the second bluetooth module is integratedly arranged in a floor registration control panel of the elevator system, wherein a third communication connection is established between the floor registration control panel and the elevator controller of the elevator system, and a fourth communication connection is established between the second bluetooth module and the floor registration control panel.

15. The communication system as claimed in claim 14, characterized in that the first communication connection and the third communication connection are remote serial connections, and the second communication connection and the fourth communication connection are serial port connections.

16. The communication system as claimed in claim 14, characterized in that the first bluetooth module is further configured to be able to send, based on the first communication connection and the second communication connection, to the elevator controller an instruction for acquiring information stored by the elevator controller from the elevator controller, and send out the information by way of bluetooth to a digital terminal which has been authorized to establish a bluetooth connection with it.

17. The communication system as claimed in claim 16, characterized in that the information stored by the elevator controller comprises at least one type of the following information: running state information, historical running status information, repairing or maintenance record information.

18. An elevator system, characterized by comprising:

a communication system as claimed in claim 1; and an elevator controller for controlling the running of one or more elevator cars in the elevator system, wherein the elevator controller is coupled to the first bluetooth module and the second bluetooth module and controls the running of the one or more elevator cars in the elevator system at least in response to the elevator calling request command and/or the target floor registration command.

19. A communication method for performing an elevator calling operation in an elevator system, characterized by comprising steps of:

receiving a first bluetooth signal broadcasted by a first bluetooth module mounted in an elevator landing area of the elevator system;

automatically establishing a first bluetooth connection between a personal mobile terminal and the first bluetooth module based on the first bluetooth signal;

sending an elevator calling request command regarding an elevator calling direction to the first bluetooth module;

disconnecting the first bluetooth connection responsive to a confirmation that the first bluetooth module successfully accepted the calling request command;

after disconnecting the first bluetooth connection, receiving a second bluetooth signal broadcasted by a second bluetooth module mounted in an elevator car of the elevator system;

automatically establishing a second bluetooth connection between the personal mobile terminal and the second bluetooth module based on the second bluetooth signal;

the personal mobile terminal sending a target floor registration command to the second bluetooth module; and disconnecting the second bluetooth connection responsive to a confirmation that the second bluetooth module successfully accepted the target floor registration command.

20. The communication method as claimed in claim 19, characterized in that in the step of automatically establishing the first bluetooth connection, the first bluetooth connection is automatically established when a signal strength of the first bluetooth signal received changes from relatively weak to equal to or greater than a first strength value; and/or in the step of automatically establishing the second bluetooth connection, the second bluetooth connection is automatically established when a signal strength of the second bluetooth signal received changes from relatively weak to equal to or greater than a second strength value.

21. The communication method as claimed in claim 19, characterized in that in the step of automatically establishing the first bluetooth connection, a distance from the personal mobile terminal to the first bluetooth module is substantially determined according to a signal strength of the first bluetooth signal received by the personal mobile terminal, and the first bluetooth connection is automatically established when the distance is smaller than or equal to a first distance threshold value; and/or in the step of automatically establishing the second bluetooth connection, a distance from the personal mobile terminal to the second bluetooth module is substantially determined according to a signal strength of the second bluetooth signal received by the personal mobile terminal, and the second bluetooth connection is automatically established when the distance is smaller than or equal to a second distance threshold value.

22. The communication method as claimed in claim 21, characterized in that the second distance threshold value is equal to or greater than 0.7 meter and is smaller than or equal to 1 meter, and the first distance threshold value is greater than the second distance threshold value.

23. The communication method as claimed in claim 20, characterized by further comprising a wake-up step before automatically establishing the first bluetooth connection: enabling the personal mobile terminal to automatically wake up from the sleep mode when the signal strength of the first bluetooth signal received by the personal mobile terminal changes from relatively weak to equal to or greater than the first strength value.

24. The communication method as claimed in claim 21, characterized by further comprising a wake-up step before automatically establishing the first bluetooth connection: enabling the personal mobile terminal to automatically wake up from the sleep mode when the distance from the personal mobile terminal to the first bluetooth module is smaller than or equal to the first distance threshold value.

25. The communication method as claimed in claim 19, characterized by further comprising a step of: after disconnecting the second bluetooth connection, the personal mobile terminal automatically entering a sleep mode.

26. The communication method as claimed in claim 19, characterized in that in the step of receiving the first bluetooth signal broadcasted by the first bluetooth module, the first bluetooth signal comprises a wake-up signal for waking up the personal mobile terminal, and the personal mobile terminal automatically wakes up from the sleep mode after receiving the wake-up signal.

27. The communication method as claimed in claim 19, characterized in that the first bluetooth signal comprises a data signal that reflects a universally unique identifier of the first bluetooth module and/or first floor location information about where the first bluetooth module is located; and/or the second bluetooth signal comprises a data signal that reflects a universally unique identifier of the second bluetooth module and/or second floor location information about where the second bluetooth module is located.

28. A communication method for performing an elevator calling operation in an elevator system, wherein a first bluetooth module mounted in an elevator landing area of the elevator system broadcasts a first bluetooth signal, and a second bluetooth module mounted in an elevator car of the elevator system broadcasts a second bluetooth signal, characterized in that the method comprises steps of:

the first bluetooth signal being received by a personal mobile terminal near the first bluetooth module;

automatically establishing a first bluetooth connection between the personal mobile terminal and the first bluetooth module based on the first bluetooth signal;

the first bluetooth module receiving an elevator calling request command regarding an elevator calling direction sent from the personal mobile terminal;

disconnecting the first bluetooth connection responsive to a confirmation that the first bluetooth module received the calling request command;

the second bluetooth signal being received by the personal mobile terminal near the second bluetooth module;

automatically establishing a second bluetooth connection between the personal mobile terminal and the second bluetooth module based on the second bluetooth signal;

the second bluetooth module receiving a target floor registration command sent from the personal mobile terminal; and disconnecting the second bluetooth connection responsive to a confirmation that the second bluetooth module received the target floor registration command.

29. The communication method as claimed in claim 28, characterized by further comprising steps of:

after the first bluetooth module receives the elevator calling request command, returning a first confirmation message to the personal mobile terminal; and/or after the second bluetooth module receives the target floor registration command, returning a second confirmation message to the personal mobile terminal.

30. The communication method as claimed in claim 28, characterized in that the first bluetooth signal comprises a data signal that reflects a universally unique identifier of the first bluetooth module and/or first floor location information about where the first bluetooth module is located; and/or the second bluetooth signal comprises a data signal that reflects a universally unique identifier of the second bluetooth module and/or second floor location information about where the second bluetooth module is located.

31. The communication method as claimed in claim 28, characterized in that the steps of automatically establishing the first bluetooth connection, receiving the elevator calling request command and disconnecting the first bluetooth connection are successively performed, so as to successively realize communication with each of a plurality of personal mobile terminals that receives the first bluetooth signal.

32. The communication method as claimed in claim 28, characterized in that the steps of automatically establishing the second bluetooth connection, receiving the target floor registration command and disconnecting the second bluetooth connection are successively performed, so as to successively realize communication with each of a plurality of personal mobile terminals that receives the second bluetooth signal.

33. The communication method as claimed in claim 28, characterized in that the personal mobile terminal establishes the first bluetooth connection or the second bluetooth connection with only one of the first bluetooth module and the second bluetooth module at a certain moment.

34. A personal mobile terminal, characterized in that the personal mobile terminal is configured to be able to receive a first bluetooth signal broadcasted by a first bluetooth module mounted in an elevator landing area of an elevator system and be able to receive a second bluetooth signal broadcasted by a second bluetooth module mounted in an elevator car of the elevator system, wherein the personal mobile terminal comprises:

a bluetooth connection management module for successively automatically establishing a first bluetooth connection with the first bluetooth module and a second bluetooth connection with the second bluetooth module respectively based on the first bluetooth signal and the second bluetooth signal;

a first command sending module for automatically sending an elevator calling request command regarding an elevator calling direction to the corresponding first bluetooth module when the first bluetooth connection is established; and a second command sending module for automatically sending a target floor registration command to the corresponding second bluetooth module when the second bluetooth connection is established;

wherein the bluetooth connection management module is further used for actively disconnecting the first bluetooth connection based on a first confirmation message received;

wherein the first confirmation message indicates that the elevator calling request command is successfully accepted by the elevator system;

wherein the bluetooth connection management module is further used for actively disconnecting the second bluetooth connection based on a second confirmation message received; and wherein the second confirmation message indicates that the target floor registration command is successfully accepted by the elevator system.

35. The personal mobile terminal as claimed in claim 34, characterized in that the personal mobile terminal further comprises:

a command generation module for generating the elevator calling request command and/or the target floor registration command based on a personalized configuration.

36. The personal mobile terminal as claimed in claim 34, characterized in that the bluetooth connection management module is configured to automatically establish the first bluetooth connection or the second bluetooth connection with only one of the first bluetooth module and the second bluetooth module at a certain moment.

37. The personal mobile terminal as claimed in claim 34, characterized in that the bluetooth connection management module is further used for determining a signal strength of the received first bluetooth signal and/or second bluetooth signal.

38. The personal mobile terminal as claimed in claim 37, characterized in that the bluetooth connection management module is further used for automatically establishing the first bluetooth connection when the signal strength of the first bluetooth signal received thereby changes from relatively weak to equal to or greater than a first strength value; and/or automatically establishing the second bluetooth connection when the signal strength of the second bluetooth signal received thereby changes from relatively weak to equal to or greater than a second strength value.

39. The personal mobile terminal as claimed in claim 37, characterized in that the bluetooth connection management module further comprises:

a distance determination submodule for substantially determining a distance from the personal mobile terminal to the first bluetooth module according to the signal strength of the first bluetooth signal, and/or substantially determining a distance from the personal mobile terminal to the second bluetooth module according to the signal strength of the second bluetooth signal and automatically establishing the second bluetooth connection when the distance is smaller than or equal to a second distance threshold value.

40. The personal mobile terminal as claimed in claim 39, characterized in that the bluetooth connection management module is further configured to: automatically establish the first bluetooth connection when the distance from the personal mobile terminal to the first bluetooth module is smaller than or equal to a first distance threshold value, and/or automatically establish the second bluetooth connection when the distance from the personal mobile terminal to the second bluetooth module is smaller than or equal to the second distance threshold value.

41. The personal mobile terminal as claimed in claim 40, characterized in that the second distance threshold value is equal to or greater than 0.7 meter and is smaller than or equal to 1 meter, and the first distance threshold value is greater than the second distance threshold value.

42. The personal mobile terminal as claimed in claim 34, characterized in that the bluetooth connection management module further comprises:

a recognition submodule for recognizing the first bluetooth signal and determining a floor location where the first bluetooth module is located.

43. The personal mobile terminal as claimed in claim 34, characterized in that the bluetooth connection management module is further used for recognizing the second bluetooth signal to acquire an elevator car corresponding to the second bluetooth module.

44. A personal mobile terminal, characterized by comprising a memory, a processor and a computer program that is stored in the memory and can run on the processor, wherein the processor realizes steps of the communication method as claimed in claim 19 when executing the program.

45. A computer readable storage medium storing a computer program thereon, characterized in that the program is executed by a processor to realize steps of the method as claimed in claim 19.

* * * * *